US008651594B2

(12) United States Patent
Jones et al.

(10) Patent No.: US 8,651,594 B2
(45) Date of Patent: Feb. 18, 2014

(54) CABINET FOR USE BESIDE A BED

(75) Inventors: Bryn Jones, Bath (GB); Paul Open, Blandford (GB); Mark Bevis, Bournemouth (GB); Christopher Ian Thompson, Bristol (GB); Craig Ian Wightman, Bristol (GB)

(73) Assignee: Hospital Metalcraft Limited (GB)

( * ) Notice: Subject to any disclaimer, the term of this patent is extended or adjusted under 35 U.S.C. 154(b) by 0 days.

(21) Appl. No.: 12/762,061

(22) Filed: Apr. 16, 2010

(65) Prior Publication Data

US 2010/0264784 A1 Oct. 21, 2010

(30) Foreign Application Priority Data

Apr. 17, 2009 (GB) ..... 0906666.3

(51) Int. Cl.
*A47B 81/00* (2006.01)

(52) U.S. Cl.
USPC ..... 312/286; 312/249.11; 108/49

(58) Field of Classification Search
USPC ..... 312/330.1, 249.8, 249.11–249.13, 280, 312/281, 351.1, 283, 286, 257.1; 108/49, 108/92, 93; 5/507.1, 503.1, 658
See application file for complete search history.

(56) References Cited

U.S. PATENT DOCUMENTS

| | | | | | |
|---|---|---|---|---|---|
| 628,322 | A | * | 7/1899 | Hoffmire | 312/286 |
| 2,272,819 | A | * | 2/1942 | Poetsch et al. | 312/198 |
| 2,404,851 | A | * | 7/1946 | Knowles et al. | 312/286 |
| 2,565,784 | A | * | 8/1951 | Sheean | 312/286 |
| 3,222,117 | A | * | 12/1965 | Schwartz | 312/264 |
| 3,285,685 | A | * | 11/1966 | Hewett | 312/287 |
| 3,314,741 | A | * | 4/1967 | Litner | 312/242 |
| 3,524,691 | A | * | 8/1970 | Moore | 312/286 |
| 3,529,880 | A | * | 9/1970 | Andreas | 312/194 |
| 3,868,123 | A | * | 2/1975 | Berg et al. | 280/79.2 |
| 3,963,125 | A | * | 6/1976 | Baggott | 211/126.15 |

(Continued)

FOREIGN PATENT DOCUMENTS

| | | | |
|---|---|---|---|
| CN | 201101664 | Y | 8/2008 |
| EP | 1716778 | A1 | 11/2006 |
| JP | 8191720 | A | 7/1996 |
| JP | 2000197530 | A | 8/2000 |

OTHER PUBLICATIONS

European Search Report, Sep. 12, 2011.

(Continued)

*Primary Examiner* — Darnell Jayne
*Assistant Examiner* — Ryan A Doyle
(74) *Attorney, Agent, or Firm* — Symbus Law Group, LLC; Clifford D. Hyra

(57) ABSTRACT

A bedside cabinet comprises a body (10) carrying two drawers (12) and (14) all made from synthetic plastics material by rotational molding. The body (10) comprises a proximal wall (16) and a distal wall (18) each extending upward from a generally horizontal platform (20), and a horizontal top (22) extending between the proximal wall (16) and the distal wall (18). An upstand (28) carries a horizontal shelf (30) extending partly over the top (22) and both the top (22) and the shelf (30) are directed towards the proximal side of the cabinet, having raised lips (32) and (34) respectively around their distal edges and their ends. The cabinet lacks dirt traps and is easily cleaned. In addition the drawers (12) and (14) are reversible so as to open forwards whether the cabinet is on the right-hand side or the left-hand side of a bed.

11 Claims, 6 Drawing Sheets

(56) References Cited

U.S. PATENT DOCUMENTS

| | | | | | |
|---|---|---|---|---|---|
| 4,178,049 | A | * | 12/1979 | Loo | 312/286 |
| 4,588,096 | A | * | 5/1986 | Story et al. | 211/126.15 |
| 4,822,116 | A | * | 4/1989 | Relyea et al. | 312/209 |
| 5,011,240 | A | * | 4/1991 | Kelley et al. | 312/249.12 |
| 5,016,948 | A | * | 5/1991 | Welch et al. | 312/249.12 |
| 5,094,418 | A | * | 3/1992 | McBarnes et al. | 248/286.1 |
| 5,259,668 | A | * | 11/1993 | Teufel et al. | 312/249.11 |
| 5,306,077 | A | * | 4/1994 | Trevaskis | 312/122 |
| 5,795,043 | A | * | 8/1998 | Johnson et al. | 312/229 |
| 5,829,767 | A | * | 11/1998 | Grossman | 280/47.35 |
| 5,839,806 | A | * | 11/1998 | Liu | 312/257.1 |
| 5,873,643 | A | * | 2/1999 | Burgess et al. | 312/290 |
| D408,953 | S | * | 4/1999 | Golichowski et al. | D34/21 |
| 6,626,445 | B2 | * | 9/2003 | Murphy et al. | 280/47.34 |
| 6,729,371 | B2 | * | 5/2004 | Sheahan et al. | 144/286.1 |
| 7,147,290 | B2 | * | 12/2006 | Arent et al. | 312/249.9 |
| 7,287,820 | B2 | * | 10/2007 | Van Loon et al. | 312/330.1 |
| 7,513,000 | B2 | * | 4/2009 | DeBraal et al. | 5/600 |
| 7,537,295 | B2 | * | 5/2009 | Jackson | 312/330.1 |
| D632,796 | S | * | 2/2011 | Ross et al. | D24/185 |
| 2003/0230957 | A1 | * | 12/2003 | Doerfler et al. | 312/257.1 |
| 2007/0199263 | A1 | * | 8/2007 | Kern et al. | 52/234 |
| 2007/0290587 | A1 | * | 12/2007 | Jeansonne et al. | 312/311 |
| 2009/0015116 | A1 | * | 1/2009 | Arceta et al. | 312/209 |
| 2009/0200902 | A1 | * | 8/2009 | McKay et al. | 312/249.12 |
| 2010/0295430 | A1 | * | 11/2010 | Cheng | 312/249.11 |

OTHER PUBLICATIONS

Prevention of hospital-acquired infections: A practical guide, 2nd ed., World Health Organization Department of Communicable Disease, Surveillance and Response, R. Girard, et al., 2002.

HCAI Technology Innovation Programme, NHS, Institute for Science and Society, Mar. 2010.

Design Bugs Out, Design Council, David Kester, et al., 2009.

Design Bugs Out—Product Evaluation Report, NHS, HCAI Technology Innovation Programme, Nov. 2011.

Design Bugs Out—Product Evaluation: Bedside Cabinet, NHS, HCAI Technology Innovation Programme, Nov. 2011.

The Plastics Industry Awards 2010, www.plasticsawards.com/pia2010/winners-2010.

The "Easy Clean"—Bedside Cabinet wins the Homers Award 2010, British Plastics Federation, http://www.bpf.co.uk/Article/Detail.aspx?ArticleUid=c7237d42-b8e8-4c4d-bb58-0be89d3f69da, Sep. 29, 2010.

Kinneir Dufort win Building Better Healthcare Award, Kinneir Dufort, http://www.kinneirdufort.com/news/kinneir-dufort-win-building-better-healthcare-award, Nov. 24, 2010.

Design Guild Marks, The Furniture Makers Company, Jun. 2011.

* cited by examiner

CABINET FOR USE BESIDE A BED

CROSS REFERENCE TO RELATED APPLICATIONS

This application claims priority from United Kingdom patent application No. 09 06 666.3 filed Apr. 17, 2009, the entire disclosure of which is incorporated herein by reference in its entirety.

BACKGROUND OF THE INVENTION

1. Field of the Invention

The present invention relates to a cabinet for use beside a bed, in which the cabinet comprises a body and a drawer in said body having a closed position defined by engagement with the body.

2. Description of the Related Art

In hospitals, care homes, hospices and like institutions it is normal to provide a cabinet beside each bed whereby patients may have their personal belongings and items of food and drink readily to hand. In such institutions the bedside cabinet needs to meet two linked criteria, namely affordability and cleanliness.

With regard to affordability, the first factor to be considered is cost of manufacture. A very large organisation such as a public health service procures furniture in very large quantities, which drives down the unit cost. However, the very size of the organisation creates a great variety of locations for such furniture: even in a single hospital, wards may be differently arranged, especially if they have different functions. For the bedside cabinet the most basic variation is between placing the cabinet to the left or the right of the patient's bed. In the past this had led to cabinets which are essentially symmetrical about a centre line and can therefore be placed on either side of the bed. But such a cabinet has two notable disadvantages. First, it faces the front, whereas for much of the time the patient is to the side. Second, it has a back, which gives rise to cleaning problems (particular inside the cabinet, when the back is closed, as it conventionally is.

A great upsurge in hospital acquired infection over recent years has focussed renewed attention on the need for cleanliness in hospitals. A rigorously enforced hygiene code is the only effective counter to Methicillin-resistant *Staphylococcus aureus* (MRSA) and *Clostridium difficile* (*C. difficile*) which are both now established in many hospitals, and also to outbreaks of norovirus; and a major component in this is ensuring cleanliness in and beside the bed, particularly in wards with rapid patient turnover and high bed occupancy. The need for cleanliness has financial implications in that the hygiene code must itself be affordable, and because patients who do become infected inevitably stay longer in hospital, creating an extra financial burden.

BRIEF DESCRIPTION OF THE INVENTION

According to an aspect of the present invention, there is provided a cabinet for use beside a bed of the aforesaid type, characterised in that the drawer may be inserted into the body alternatively from each of two opposite ends of the body and said engagement is such that the drawer may be withdrawn from the end whereby it has been inserted but not from the other end of the body.

By inserting the drawer from one of the said ends, the cabinet may be arranged so that the drawer opens forwards (ie generally towards the foot of the bed) when the cabinet is on one side of the bed. If the cabinet is required to be placed on the other side of the bed then by inserting the drawer from the other of the said ends it will still open forwards. Those skilled in the art will appreciate that this is particularly convenient when cabinets are taken to be spray cleaned at a central station and may afterwards not be returned to their former locations.

Preferably, to facilitate cleaning, the body of the cabinet is open at and between said opposite ends.

As an additional aid to cleanliness, the drawer preferably has a front and a back which in the closed position of the drawer are each recessed from said ends. This means that spillage on the cabinet will not seep into the drawer.

The drawer may have sides extending between its front and its back, which sides are of reduced height between front and back. This makes it easier for a patient to access the drawer from the bed.

Preferably the body of the cabinet comprises a proximal wall disposed in use adjacent a side of the bed and a distal wall opposite the proximal wall, the drawer lying between said walls and the body being otherwise open therebetween. The proximal wall and the distal wall are preferably each formed with a runner to carry the drawer in sliding engagement therewith, and the runners may be formed with a detent operative to check the drawer against removal from the body.

The body of the cabinet preferably comprises a top extending between the proximal and distal walls, and this top may be formed with a raised rim extending along its distal edge and orthogonally thereto in line with each of said opposite ends. The body may also comprise an upstand extending upwards from said top and carrying a shelf extending at least partly over said top, and this shelf may be formed with a raised rim extending along its distal edge and orthogonally thereto parallel with each of said opposite ends. With this arrangement the rim along the distal edge of the shelf may be configured and arranged to carry a patient care accessory such as a holder for alcohol gel, gloves or a sharps box. In addition the upstand may be formed with one or more hooks on its distal face.

The body of the cabinet preferably includes a platform from which the proximal wall and the distal wall each extend upward. The cabinet preferably includes castors underneath the platform whereby the cabinet may be moved, and the platform may be formed with outwardly extending shoulders providing buffers while the cabinet is being moved.

The cabinet may comprise two said drawers.

Preferably the body of the cabinet and the or each drawer are each formed in one piece from synthetic plastics material, which may be done by rotational moulding. Preferably, too, all edges in the body and in the or each drawer are rounded, for ease of cleaning.

The or each drawer may formed with an upturned handle. Also the cabinet may include a lock, preferably without a keyhole, for at least one said drawer.

Other features of the invention will be apparent from the following description, which is made by way of example.

DETAILED OF DESCRIPTION OF A PREFERRED EMBODIMENT

Figure 1:
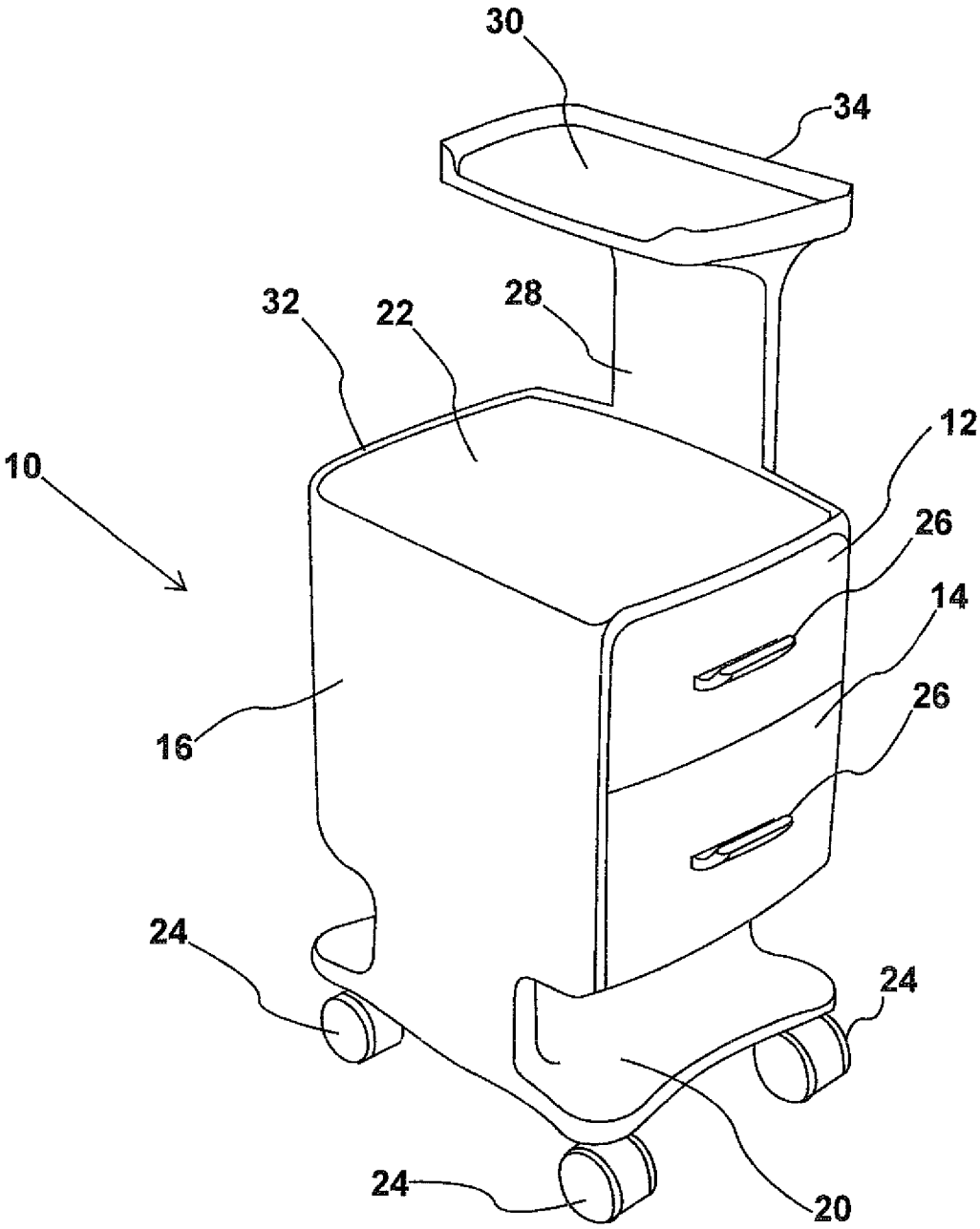
FIG. 1 is an isometric view of a bedside cabinet embodying the invention, viewed from its proximal side and one end, the cabinet including two drawers.

The following description of the invention begins with an overview with reference to all the figures, which use the same reference numerals throughout.

The bedside cabinet shown in the drawings comprises a body indicated generally at 10, and an upper drawer 12 and a lower drawer 12 and 14 carried by the body 10. The body 10 comprises a proximal wall 16 and a distal wall 18 each extending upward from a generally horizontal platform 20, and a generally horizontal top 22 extending between the proximal wall 16 and the distal wall 18. Underneath the platform are four castors 24 whereby the cabinet may be readily moved, for cleaning and/or redeployment. Each of the drawers 12 and 14 has a front formed with a handle 26. An upstand 28 extends upward from the top 22 and carries a generally horizontal shelf 30 extending partly over the top 22.

The body 10 and each of the drawers 12 and 14 are made from high density polyethylene or a similar synthetic plastics material by rotational moulding (sometimes called 'roto-moulding'). In this process a heated mould is charged with thermoplastic resin, the resin melts and then the mould is slowly rotated about two mutually orthogonal axes so that its internal surface becomes coated with the resin. The mould is then allowed to cool while still being rotated, until the plastics material solidifies. Rotational moulding has two notable features which make it especially appropriate for making a cabinet according to the invention. First, it facilitates the manufacture of hollow-walled items, which combine strength with lightness and may be further stiffened with a foam filling. And second it enables all edges and corners to be rounded (as can be seen in the accompanying drawings) so that the cabinet so manufactured lacks dirt-traps and is easily cleaned.

It may be noted here that the synthetic plastics material used in the manufacture of the cabinet could include an anti-microbial additive to inhibit the growth of bacteria. However research suggests that some healthcare staff may be less scrupulous about cleaning furniture including such an additive and therefore it is preferred to omit it from the present invention.

The invention having been described in outline, more particular features will now be described.

Figure 2:
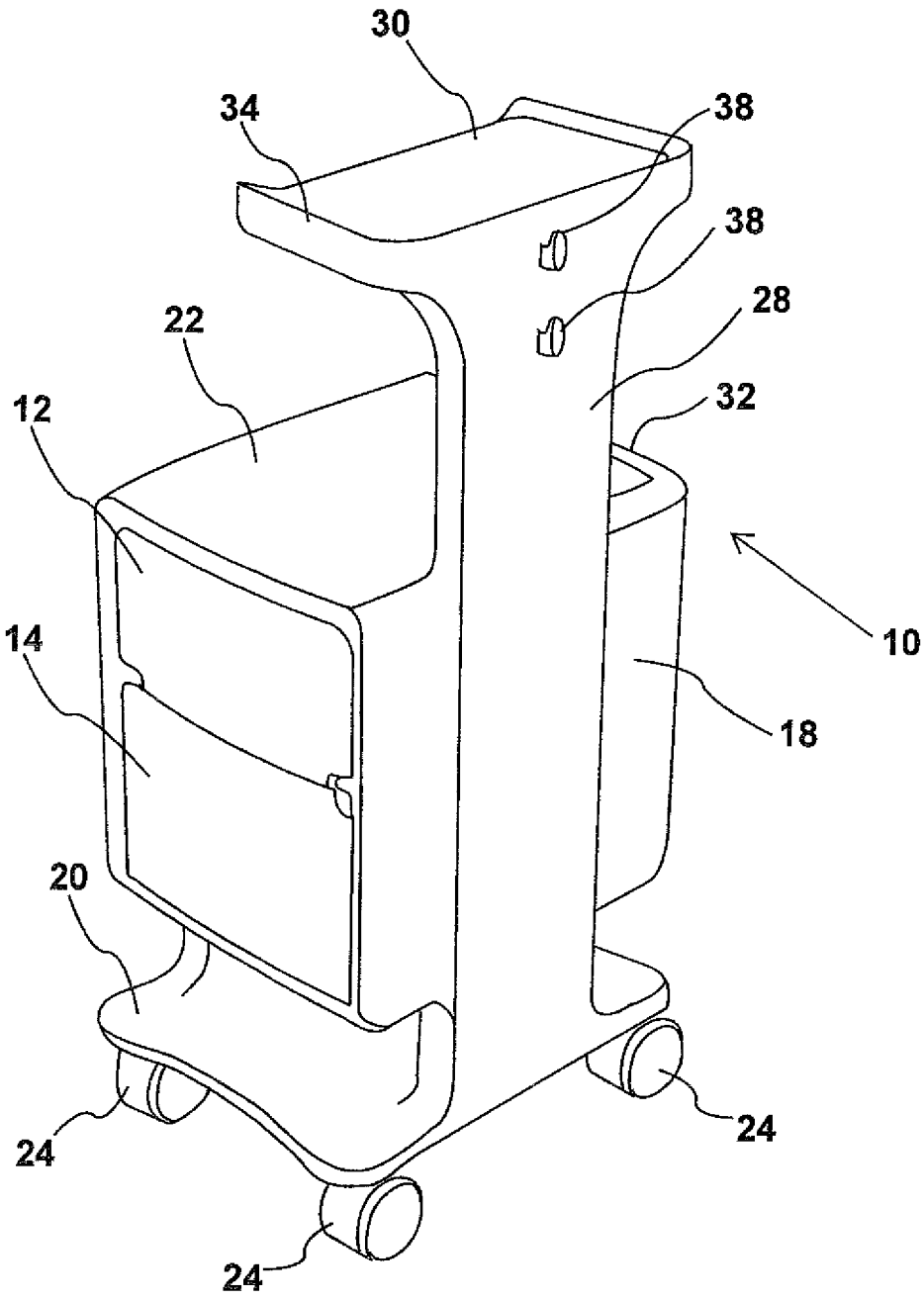
FIG. 2 is an isometric view of the bedside cabinet, viewed from its distal side and the other end.

Referring to FIGS. 1 and 2, these show the cabinet with each of the drawers 12 and 14 closed. For each of the drawers 12 and 14 this closed position is defined by engagement between the front of the drawer (visible in FIG. 1) and the corresponding end of the body 10, so each of the drawers 12 and 14 is stopped in its closed position and will not move any further through the body 10. In other words, each drawer can be pulled out from the end in which it was inserted but it cannot move in the other direction. If required, the drawer can be removed from the end in which it was inserted and then reinserted in the other end, and then the drawer can only be pulled out from that end.

In the closed position, the fronts of each of the drawers 12 and 14 are slightly recessed relative to the corresponding end of the body 10, to combat the possibility of leakage into the drawers 12 and 14 in the event of some spillage on the cabinet. Similarly the backs of the drawers 12 and 14 are recessed relative to the other end of the body 10, as can be seen in FIG. 2.

As can also be seen from the accompanying drawings, the cabinet is not symmetrical, but rather has a well-defined proximal side which in use faces the patient's bed. Thus the top 22 of the body 10 has a raised lip 32 along its distal edge and its two end edges, but not along its proximal edge. With the proximal wall of the body 10 against the patient's bed, the patient can easily reach items on the top 22 of the cabinet such as books, fruit or a drink. If the drink or anything else is spilt on the top 22 the lip 32 channels it towards the proximal side of the cabinet, and away from the distal side where it could get on to the floor and be trodden across the ward. In the same way, and for the same reasons, the shelf 30 has a raised lip 34 along its distal edge and its two end edges, but not along its proximal edge. The lips 32 and 34 contribute to both ward cleanliness and patient convenience.

Figure 5:
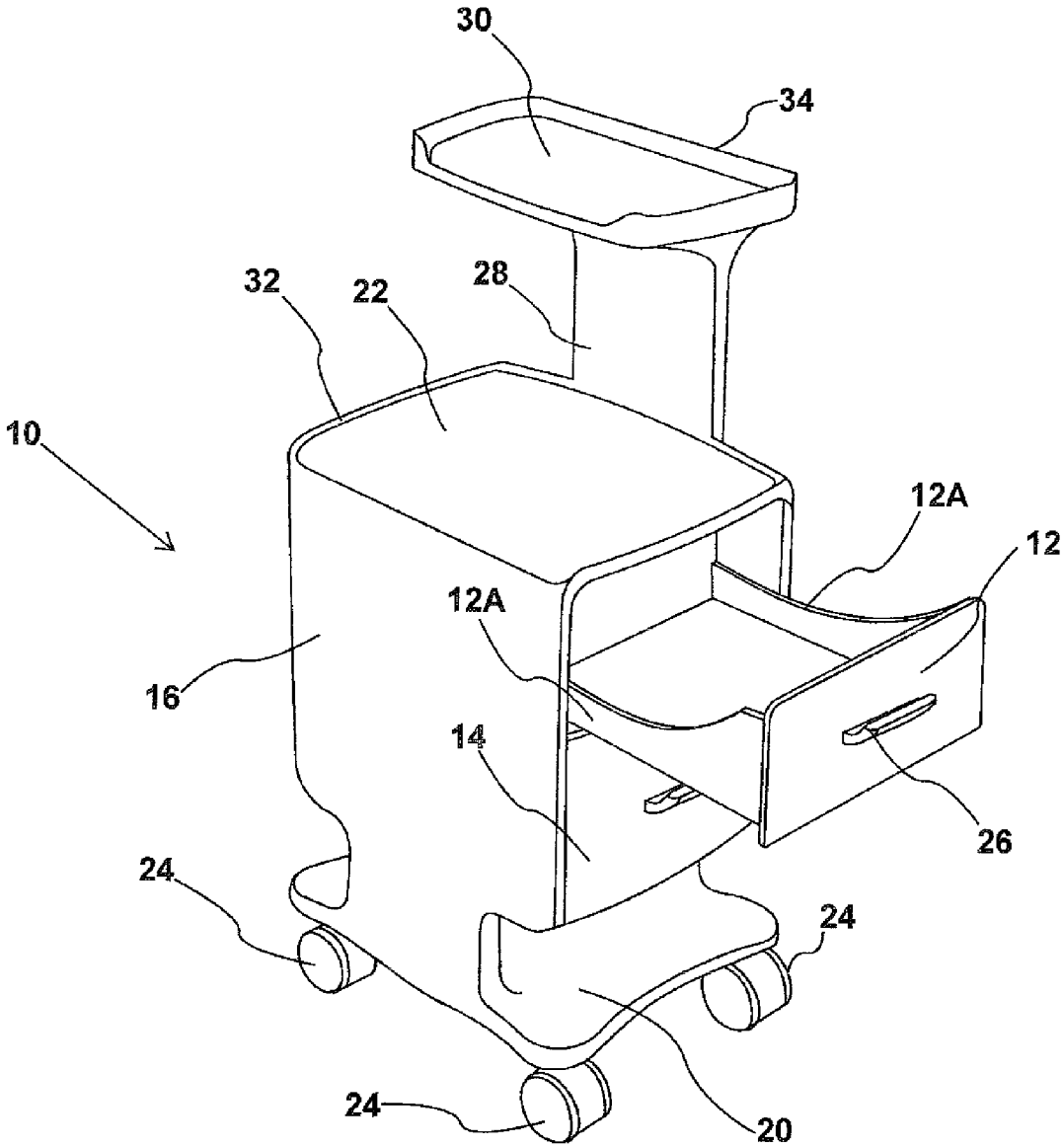
FIG. 5 is a view of the cabinet corresponding to FIG. 1 showing one drawer open.

Another contribution to patient convenience will now be described with reference to FIG. 5. This shows that the drawer 12 (which is shown open in FIG. 5) has sides 12*a* which are of dished form so as to be of reduced height between front and back. The drawer 14 has similar sides. This arrangement makes it easier for a patient in bed to reach into either of the drawers 12 and 14 to access their contents.

Figure 6:
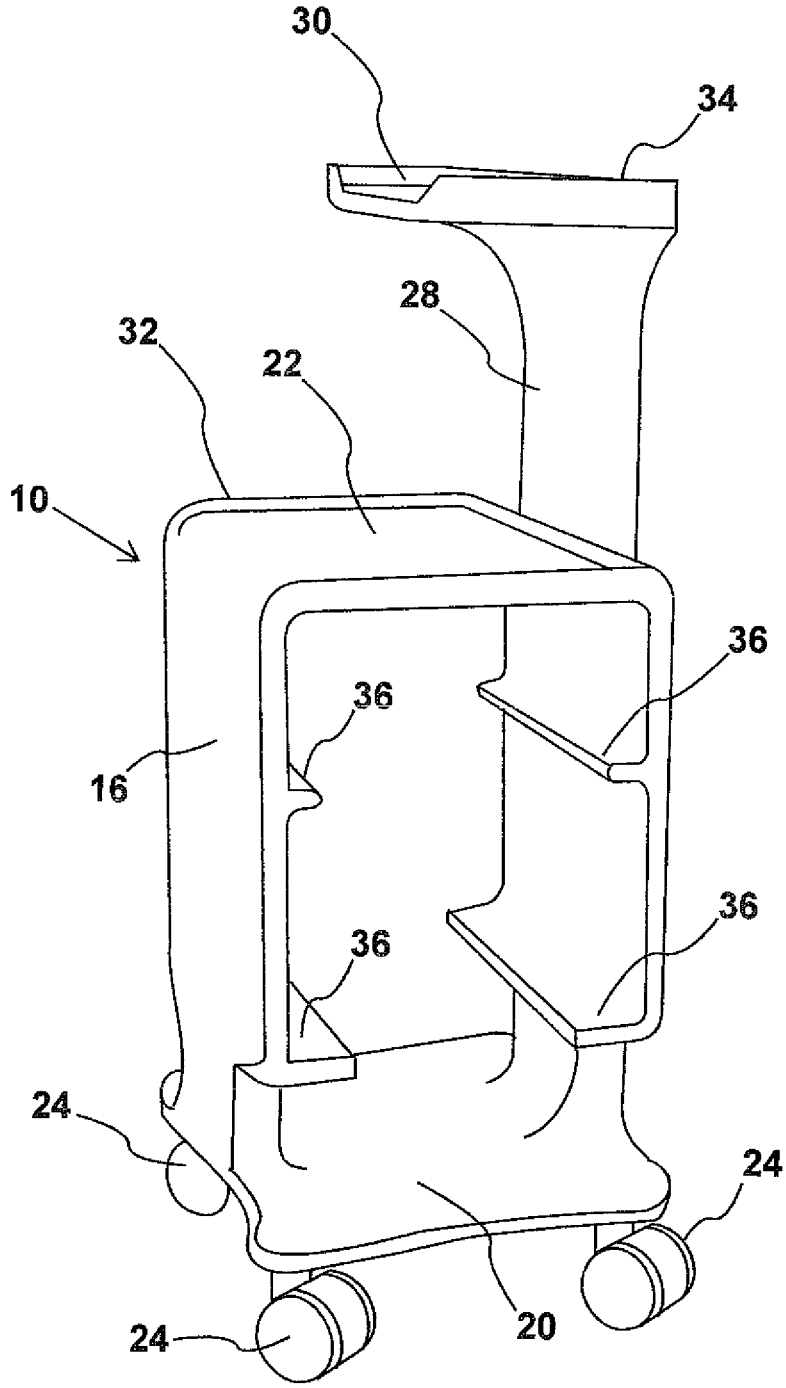
FIG. 6 is a view of the cabinet corresponding to FIG. 1 showing both drawers removed.

Referring now to FIG. 6 and considering this alongside FIG. 2, it will be understood that the body 10 is open from end to end, between its proximal wall 16 and its distal wall 18. The proximal wall 16 and the distal wall 18 each carry runners 36 on their inside faces, whereby the drawers 12 and 14 are mounted for opening and closing movement in the body 10. Although not detailed in the drawings (and this is considered unnecessary because it will be readily understood by those skilled in the art) each of the runners 36 is equipped with a detent or 'bump point' operative to check the drawers 12 and 14 against being pulled completely out of the body 10. In well known fashion, if either of the drawers 12 and 14 is required to be removed, it is tilted to clear the bump point.

Figure 3:
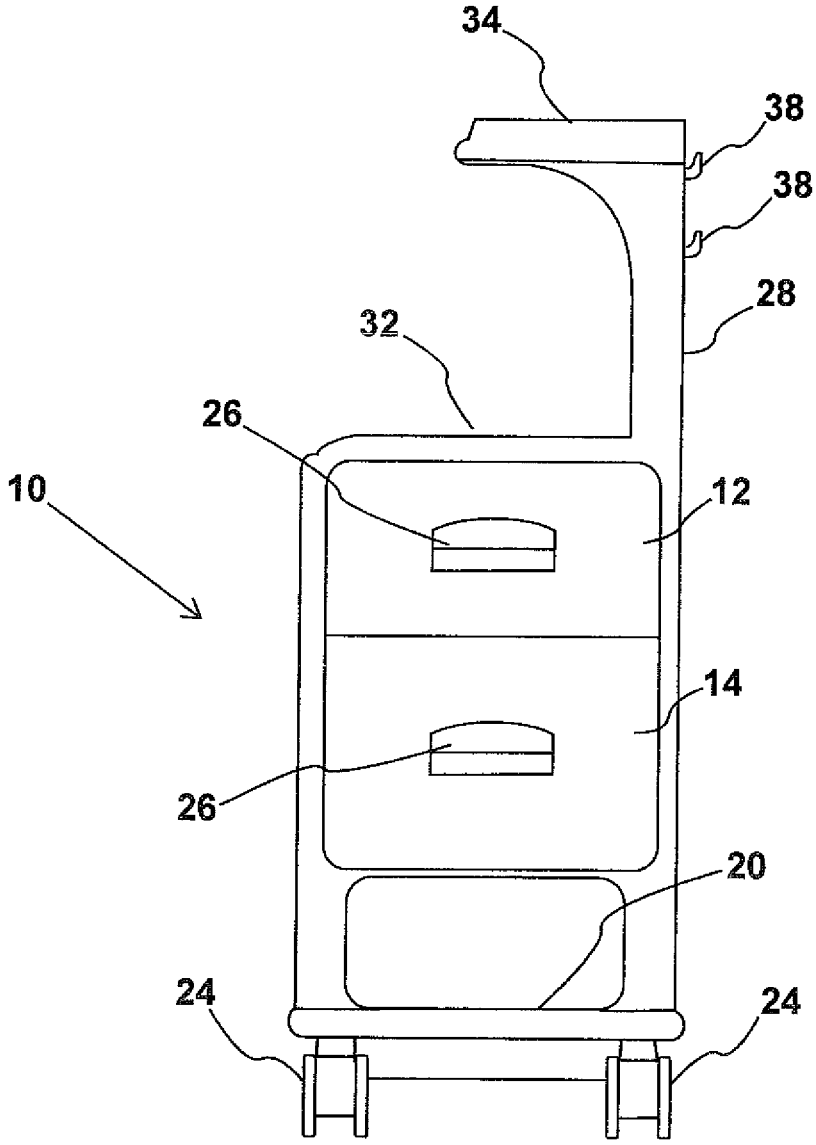
FIG. 3 shows the cabinet in elevation, viewed from the front.

One reason for removing the drawers 12 and 14 is to clean the cabinet, and it will now be apparent that the rounded edges of the cabinet and the open structure of the body 10 makes this easily done both in situ (using a cleaning cloth or the like) or at a central cleansing station where the cabinet may be pressure-washed and disinfected. Those skilled in the art will understand also that cleanliness is a matter of visibility as well as cleanability—that is, it is much easier to keep something clean when it is not hidden away. This is accomplished in the present invention by the open form of the body 10 and also (see FIG. 3 especially) by the clearance both above and below the platform 20. The clearance above the platform 20, which derives from the form of the proximal and distal walls 16 and 18, means that dirt and possible infection does not accumulate out of sight around a basin that may typically be carried on the platform 20. The clearance below the platform 20 stems from the use of relatively large castors 24, which are 100 mm diameter, and makes it easier to see and dust or other dirt accumulating under the cabinet.

It should also be understood that the large diameter of the castors 24 makes it easier to move the cabinet for cleaning the floor underneath it. Further, as can be seen clearly from FIG. 1 for instance, the platform 20 is formed with shoulders which extend outwardly over the castors 24 to serve as buffers while the cabinet is being moved. Between these shoulders the platform 20 is somewhat reduced in length and breadth, further improving visibility below the cabinet.

A second reason for removing the drawers 12 and 14 is to adapt the cabinet to a new location as follows. The proximal wall 16 of the body 10 is intended to be adjacent one side of a patient's bed. Thus, as configured for instance in FIG. 1, the proximal wall 16 will naturally face the right-hand side of the bed, as viewed from the foot of the bed, so that the drawers 12 and 14 open forwards generally towards the foot of the bed. If the cabinet is instead to be located on the left-hand side of the bed, the cabinet needs to be turned around so that its proximal wall 16 faces the left-hand side of the bed. So that the drawers 12 and 14 open forwards in this location, they are simply removed from one end of the body 10 and re-inserted from the other end.

It follows from the above that a cabinet according to the invention is economical in that with minimal effort it can be configured for location on either side of a patient's bed whilst still offering the patient the benefits of proximal shaping of the body 10 and forward opening of the drawers 12 and 14. Further, when a plurality of cabinets are moved, for instance for pressure washing at a central cleansing station, it is not necessary label them with their locations, or even to keep their components together, because the bodies and drawers are of common form and cabinets can be assembled from them to fit any location.

Hospital wards are commonly short of hanging space for clothing. As can be seen from FIG. 2, the cabinet of the invention is formed with two hooks 38 whereon coats etc may conveniently be hung. It will be noted that the hooks 38 are on the distal side of the upstand 28, where they are away from the patient's bed and easily accessed by visitors to the patient.

Figure 4:
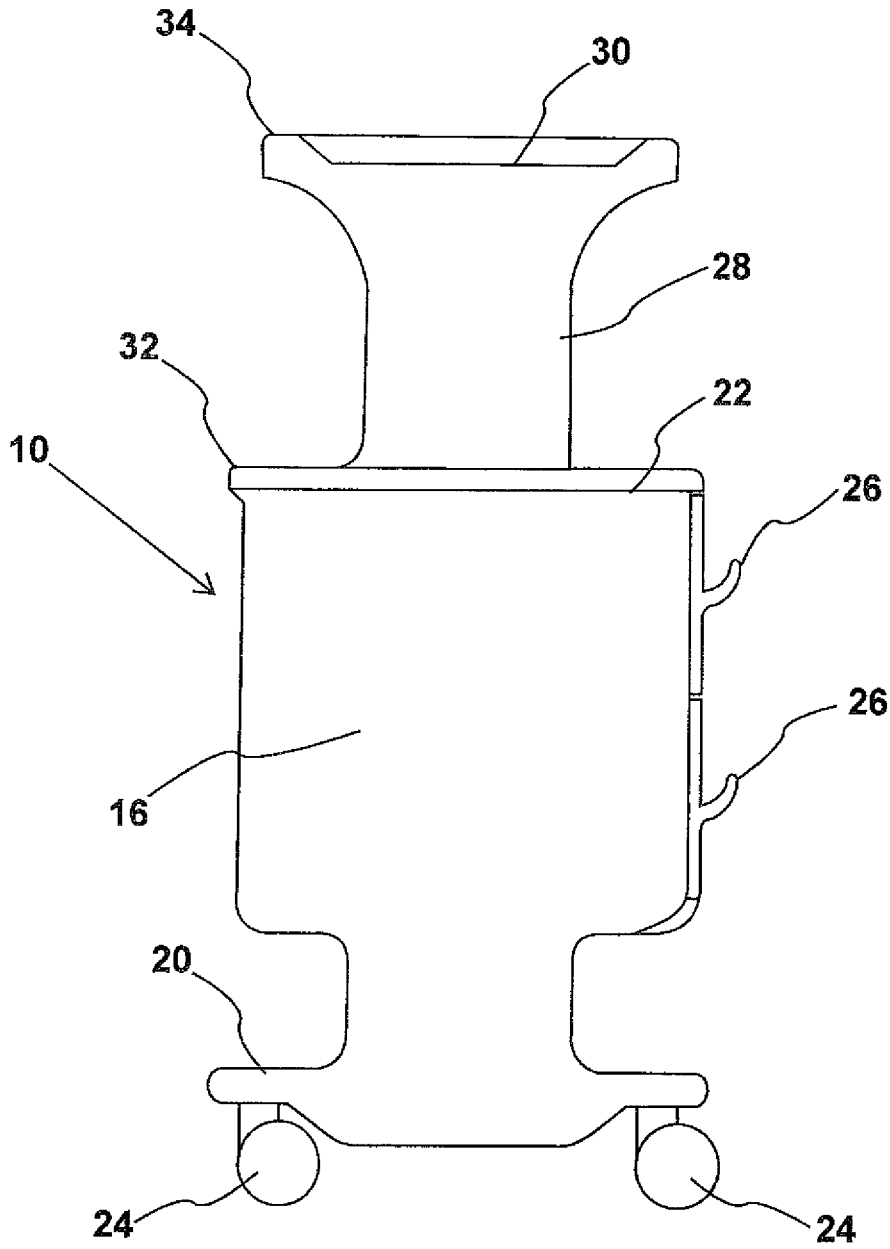
FIG. 4 shows the cabinet in elevation, viewed from its proximal side.

Finally, FIG. 4 makes it clear that the handles 26 on the drawers 12 and 14 are each upturned, which makes it easier for a patient to open the drawers 12 and 14, particularly from the bed, because the patient will most naturally use his or her upper hand for this, and the fingers on the upper hand will most comfortably point downwards to hook over an upturned handle 26.

Various modifications to and adaptations of the cabinet described may be made without departing from the scope of the invention. For instance, the cabinet may be equipped with only one drawer, or with more than the two described. Also, at least one drawer may be provided with a lock, for security; and to avoid providing an unnecessary dirt-trap it is recommended that this lock be electronic or otherwise arranged to require no keyhole. The rim 34 of the shelf 30 may be formed along its distal edge to carry a patient care accessory such as a holder for alcohol gel or a glove box or a sharps bin.

It should also be noted that, whilst the invention has been described with reference to a bedside cabinet for use in hospitals and the like, its use is not necessarily so limited. For instance it might be adapted for use as a chairside trolley in a doctor's or dentist's surgery; or it could be used outside the healthcare field altogether, for instance in hotels, where a robust construction, adaptability of location and easy-cleaning are all important.

Other possible modifications and adaptations will be apparent to those skilled in the art.

The invention claimed is:

1. A cabinet for use beside a bed, comprising:

a body open at and between a first end and a second end longitudinally spaced apart from the first end and between a proximal wall and a distal wall laterally spaced apart from the proximal wall; and at least one drawer extending substantially between said ends, said drawer having a front, wherein:

the cabinet has a first configuration in which said drawer is inserted into and openable only from the first end of the body when the proximal wall of the body is to be located against a right-hand side of the bed and a second configuration in which the drawer is inserted into and openable only from the second end of the body when the proximal wall of the body is to be located against a left-hand side of the bed, said first and second configurations being alternatives requiring no modification of the drawer;

the cabinet is formed with all edges rounded to facilitate cleaning and to deter lodging of germs and sources of infection;

the body includes a top extending between the proximal wall and the distal wall, which top is symmetrical about a lateral central plane but asymmetrical about a longitudinal central plane;

wherein the drawer is insertable into the body from either one of the first and second ends and has when inserted into the body a closed position defined by engagement of the drawer with said one end, in which closed position the drawer front extends from said one end to the other end and can be opened only from said one end.

2. The cabinet of claim 1, wherein the drawer has a back recessed from the end opposite that into which the drawer has been inserted and wherein in the closed position of the drawer the back and the front are each recessed from said ends.

3. The cabinet of claim 2, wherein the drawer has sides extending between its front and its back, which sides are of reduced height between front and back.

4. The cabinet of claim 1, wherein the top extends between said ends and between said walls with an asymmetrical configuration to facilitate access by a person in the bed.

5. The cabinet of claim 4, wherein said proximal wall and said distal wall are each formed with a runner to carry the drawer in sliding engagement therewith.

6. The cabinet of claim 4, wherein said top is formed with a raised rim extending along its distal edge and orthogonally thereto in line with each of said opposite ends.

7. The cabinet of claim 6, wherein the body comprises an upstand extending upwards from the distal edge of said top and carrying a shelf extending at least partly over said top.

8. The cabinet of claim 7, wherein the upstand is formed with one or more hooks on its distal end.

9. The cabinet of claim 1, wherein the body and the or each drawer are each formed in one piece from synthetic plastics material.

10. The cabinet of claim 9, wherein the body and the or each drawer are formed by rotational moulding.

11. Furniture for a hospital comprising a plurality of bedside cabinets as claimed in claim 1 characterised in that each drawer fits each body, whereby the cabinets may be disassembled for cleaning and sterilisation and reassembled with any drawer in any body and in either said configuration.

* * * * *